US006921442B2

(12) United States Patent
Noguchi et al.

(10) Patent No.: US 6,921,442 B2
(45) Date of Patent: Jul. 26, 2005

(54) NICKEL-BASED HEAT-RESISTANT ALLOY

(75) Inventors: Manabu Noguchi, Kanagawa (JP); Kei Matsuoka, Tokyo (JP); Hiroshi Yakuwa, Kanagawa (JP); Akira Uchino, Tokyo (JP); Hideyuki Sakamoto, Tokyo (JP); Michio Okabe, Aichi (JP); Yoshiyuki Sawada, Aichi (JP); Shigeki Ueta, Aichi (JP)

(73) Assignees: Ebara Corporation, Tokyo (JP); Daido Tokushuko Kabushiki Kaisha, Aichi (JP)

( * ) Notice: Subject to any disclaimer, the term of this patent is extended or adjusted under 35 U.S.C. 154(b) by 0 days.

(21) Appl. No.: 10/399,916

(22) PCT Filed: Oct. 24, 2001

(86) PCT No.: PCT/JP01/09340

§ 371 (c)(1),
(2), (4) Date: Oct. 3, 2003

(87) PCT Pub. No.: WO02/34956

PCT Pub. Date: May 2, 2002

(65) Prior Publication Data

US 2004/0052677 A1 Mar. 18, 2004

(30) Foreign Application Priority Data

Oct. 25, 2000 (JP) ..... 2000-325869

(51) Int. Cl.[7] ..... C22C 30/00

(52) U.S. Cl. ..... 148/442; 148/428; 420/445; 420/448; 420/450; 420/584.1; 420/588

(58) Field of Search ..... 148/428, 442; 420/445, 450, 448, 584.1, 588

(56) References Cited

U.S. PATENT DOCUMENTS

| | | | | |
|---|---|---|---|---|
| 4,388,125 A | * | 6/1983 | Benn | 148/428 |
| 5,543,109 A | | 8/1996 | Senba et al. | |
| 6,210,635 B1 | * | 4/2001 | Jackson et al. | 420/445 |
| 6,258,317 B1 | * | 7/2001 | Smith et al. | 420/448 |

FOREIGN PATENT DOCUMENTS

| | | |
|---|---|---|
| JP | 50-010720 A | 2/1975 |
| JP | 59-28552 | 2/1984 |
| JP | 59-31854 | 2/1984 |
| JP | 7-216511 | 8/1995 |
| JP | 9-250897 | 9/1997 |

OTHER PUBLICATIONS

Peter Elliott, "Aspects of Materials Performance in High Temperature Waste Combustion Systems", CORROSION 92, Paper No. 130 (1992).

Dai 19 kai Zenkoku Toshi Seisou Kenkyu Happyokai Kouen Ronbunshuu, Dec. 25, 1997, Shadan Houjin Zenkoku Toshi Seisou Kaigi ed., pp. 199–201.

Patent Abstracts of Japan, vol. 1997, No. 08, Aug. 29, 1997, Abstract of JP 09–108888A.

Patent Abstracts of Japan, vol. 2000, No. 11, Jan. 3, 2001, Abstract of JP 2000–213721A.

* cited by examiner

*Primary Examiner*—John P. Sheehan
(74) *Attorney, Agent, or Firm*—Wenderoth, Lind & Ponack, L.L.P.

(57) ABSTRACT

The present invention relates to a Ni base alloy having sufficient strength at high temperatures and high corrosion resistance at high temperatures in a high-temperature composite corrosive environment in which chlorination or sulfidation occurs simultaneously with high-temperature oxidation, without excessive cooling or surface protection. According to the present invention, a Ni base alloy having high-temperature strength and corrosion resistance includes Cr in a range of from 25 to 40 weight %, Al in a range of from 1.5 to 2.5 weight %, C in a range of from 0.1 to 0.5 weight %, W of 15 weight % or less, Mn of 2.0 weight % or less, Si in a range of from 0.3 to 6 weight %, Fe of 5% or less, and Ni of rest except inevitable impurities. When strength at high temperatures is allowed to be small, W is in a range of from 0 to 8%, and Si is in a range of from 0.3 to 1% or from 1 to 6%. In order to enhance strength at high temperatures, W is in a range of from 8 to 15, and Si is in a range of from 0.3 to 1% or from 1 to 6%.

6 Claims, 7 Drawing Sheets immediately after polishing left in room for 4 hours immediately after polishing left in room for 4 hours immediately after polishing left in room for 4 hours

NICKEL-BASED HEAT-RESISTANT ALLOY

TECHNICAL FIELD

The present invention relates to a Ni base alloy having high corrosion resistance in a strongly corrosive environment in which chlorination, sulfidation, or the like occurs simultaneously with high-temperature oxidation.

BACKGROUND ART

As alloys which have high strength and high corrosion resistance and which are used at temperatures around 1000° C., there have been known alloys into which Cr (chromium) for improving corrosion resistance and W (tungsten) for improving strength are added. When these alloys, e.g., commercial Ni-33Cr-15W alloys, are exposed at a high temperature to an environment including Cl (chlorine) and S (sulfur) having high concentrations, they are subjected to extremely large corrosion damage. Particularly, since the environment includes Cl, corrosion is considerably promoted. Because chlorides have a low melting point and a high volatility, a protective scale cannot be formed against corrosion, so that chlorides cause considerably large corrosion damage to metallic materials. Conventionally, metallic materials cannot be used as they are in a high temperature, strongly corrosive environment including chlorides, and therefore metallic materials may be cooled to prolong their lifetime.

In view of reducing corrosion, it is desirable to cool a metallic material to lower the temperature of metal in order to prolong lifetime. However, for the purpose of using in an environment around 1000° C., cooling is not desirable because the temperature of the atmosphere is lowered.

A corrosion test was taken for the purpose of measuring corrosion resistance in an environment including HCl (hydrogen chloride). A commercial Ni-33Cr-15W alloy (also referred to as "T alloy") which has been used as an alloy having high strength at high temperatures and high corrosion resistance was used as a specimen. A gas including HCl ($N_2$-10% $O_2$-1000 ppm) was flowed over the specimen, and in this state, the specimen was held at 900° C. for 200 hours. FIG. 6 is microphotographs of cross-sections of the T alloy specimen after the test. The T alloy had strong internal corrosion, and when the specimen was polished to a mirror finish and left in a room, sweat was formed on a surface of the specimen. This is because chloride included in the alloy has deliquescence such that it is coupled to moisture in air to form sweat on the surface of the specimen. Thus, chlorination occurs, and materials are subject to considerable corrosion.

DISCLOSURE OF INVENTION

In order to solve the above drawbacks, an object of the present invention is to provide an alloy having sufficient strength and high corrosion resistance in a high-temperature corrosive environment in which chlorination or sulfidation occurs simultaneously with high-temperature oxidation, without excessive cooling or surface protection.

In order to develop an alloy having the aforementioned excellent characteristics, it is necessary to understand the mechanism of generation of chlorination. The inventors took corrosion tests on a commercial Ni-33Cr-15W alloy at temperatures of 900° C., 1000° C., 1100° C., and the results were obtained as shown in FIG. 7. As shown in FIGS. 6 and 7, the amount of corrosion was maximized at 900° C., and there was tendency that the amount of corrosion was reduced as the temperature was higher. Although sweat was formed on a cross-section of a specimen at 900° C., no sweat was seen in specimens at 1000° C. and 1100° C. Thus, at 1000° C. and 1100° C., it can be seen that the formation of chloride was prevented and the amount of corrosion was reduced.

An alloy into which Al (aluminum) was added for improving corrosion resistance was produced, and a corrosion test was taken on the alloy at 900° C. in an environment including Cl. Al was added into a commercial Ni-33Cr-15W alloy, while the amount of W was reduced to maintain phase stability of the alloy. In this corrosion test, Ni-33Cr-10W-2Al was used as an alloy into which Al was added. FIG. 1 shows a cross-sectional morphology after the corrosion test. After the specimen was polished to a mirror finish, it was left in a room for 4 hours. In the alloy including Al, sweat as seen in Ni-33Cr-15W alloy of FIG. 6 was not formed at all. It can be seen that addition of Al prevented the formation of the chlorides in the alloy.

The amount of corrosion became large at temperatures around 900° C., and there was tendency that the amount of corrosion was reduced as the temperature was higher. In order to understand behavior of corrosion in an environment including Cl, corrosion tests were taken at several temperatures on an alloy into which Al and Si (silicon) were added for improving corrosion resistance. Al and Si were added into a commercial Ni-33Cr-15W alloy, while the amount of W was reduced to maintain phase stability of the alloy. In these corrosion tests, Ni-33Cr-10W-2Si-2Al was used as an alloy into which Al and Si were added. As a result of the corrosion tests, it can be shown that there is temperature dependency as shown in FIG. 2, and intensive corrosion around 900° C. can be reduced by adding Al. Although addition of only Si increases the amount of corrosion, addition of both Al and Si can improve corrosion resistance. When Al is added into an alloy for reducing intensive corrosion at temperatures from 800 to 900° C., and Si for improving corrosion resistance and W for improving strength at high temperatures are added into the alloy in proper amounts, the alloy can show an additional effect in a case where a material is used within these temperature regions.

The present invention has been completed based on the aforementioned tests.

Specifically, the present invention has solved the above problems by the following means.

(1) An Ni base alloy having high-temperature strength and corrosion resistance, the Ni base alloy including Cr in a range of from 25 to 40 weight %, Al in a range of from 1.5 to 2.5weight %, C (carbon) in a range of from 0.1 to 0.5 weight %, W of 15 weight % or less, Mn (manganese) of 2.0 weight % or less, Si in a range of from 0.3 to 6 weight %, Fe of 5% or less, and Ni (nickel) of rest except inevitable impurities.

(2) An Ni base alloy having high-temperature strength and corrosion resistance according to the item (1), the Ni base alloy characterized by including W of 8 weight % or less, and Si in a range of from 0.3 to 1 weight %.

(3) An Ni base alloy having high-temperature strength and corrosion resistance according to the item (1), the Ni base alloy characterized by including W of 8 weight % or less, and Si in a range of from 1 to 6 weight %.

(4) An Ni base alloy having high-temperature strength and corrosion resistance according to the item (1), the Ni base alloy characterized by including W in a range of from 8 to 15 weight %, and Si in a range of from 0.3 to 1 weight %.

(5) An Ni base alloy having high-temperature strength and corrosion resistance according to the item (1), the Ni base alloy characterized by including W in a range of from 8 to 15 weight %, and Si in a range of from 1 to 6 weight %.

According to the present invention, as described above, Si and Al are added into a Ni base alloy having high-temperature strength and corrosion resistance to improve its high-temperature corrosion resistance. It is possible to provide a Ni base alloy suitable for its use by changing the amount of W or Si with regard to its composition.

The Ni base alloy should have basic characteristics so as to have corrosion resistance in an environment including Cl.

BEST MODE FOR CARRYING OUT THE INVENTION

In alloys according to the present invention, an alloy described in the item (1) is referred to as "a basic alloy according to the present invention". A ratio (weight %) of adding each element in the basic alloy according to the present invention, and reasons for such a ratio will be described below.

Cr is an essential element for improving high-temperature corrosion resistance, is coupled to oxygen in an atmosphere to form a scale of $Cr_2O_3$, and has good high-temperature corrosion resistance. At temperatures above 1000° C., an alloy into which Cr is added in an amount of less than 25% does not achieve sufficient effects, and when Cr is added in an amount of more than 40%, formation of α-Cr precipitation may reduce high-temperature corrosion resistance. Therefore, an amount of adding Cr is limited to 25% to 40%.

Figure 1:
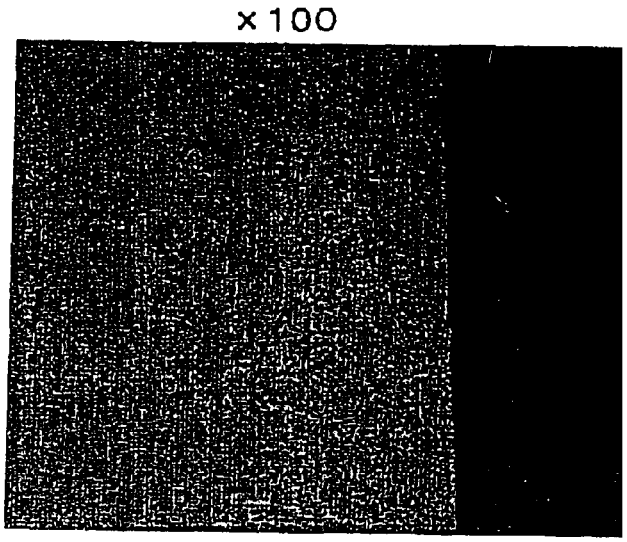
FIG. 1 is microphotographs of cross-sections of an alloy according to the present invention in a test at 900° C. in an environment including Cl, one of which shows a cross-section immediately after polishing, the other of which shows a cross-section after being left in a room.
Figure 1:
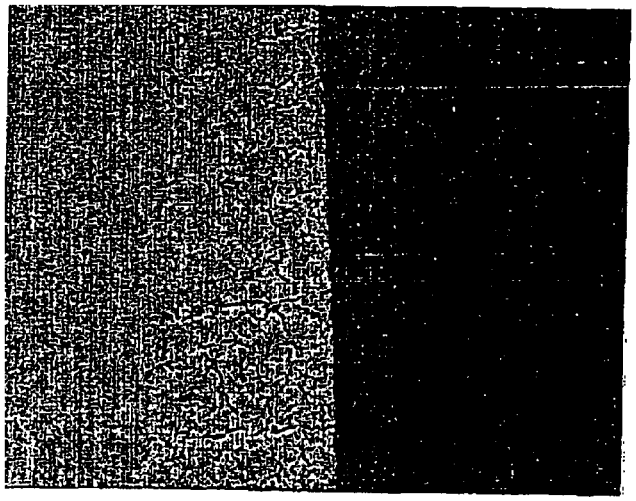
Figure 2:
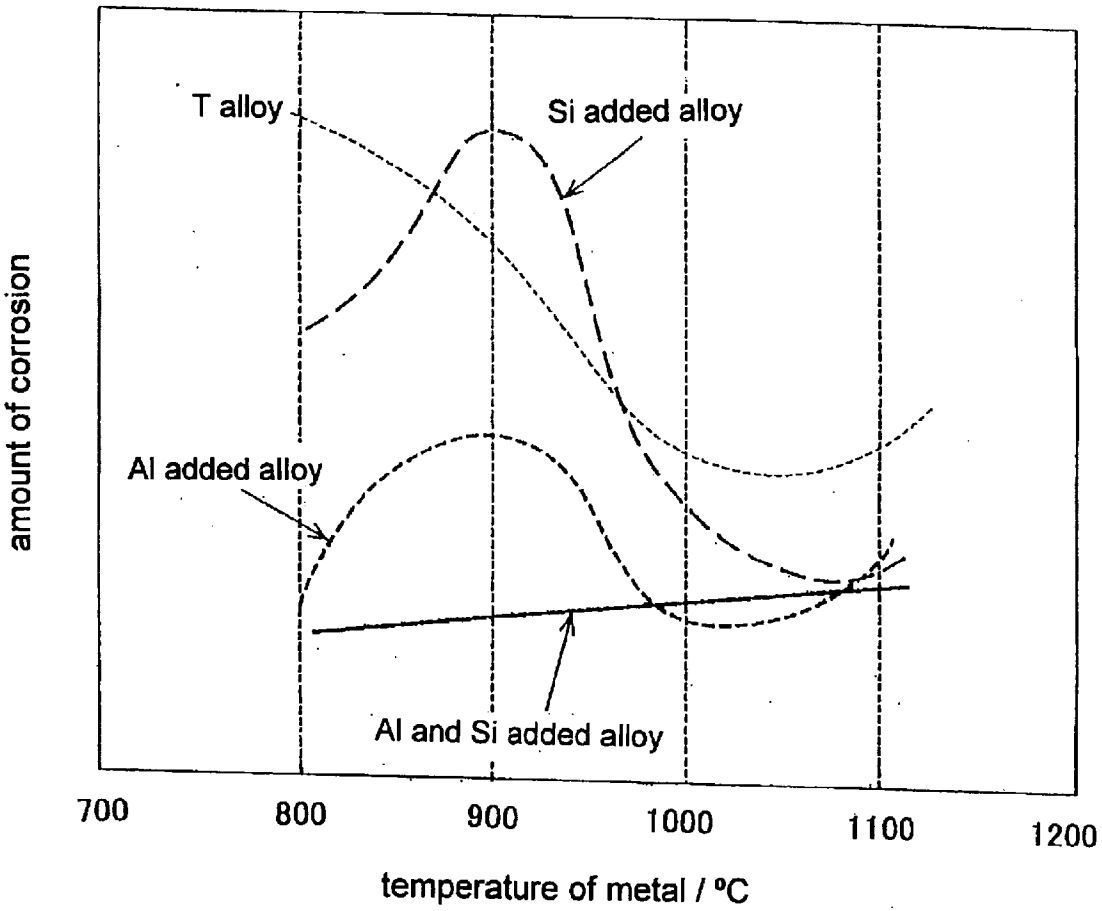
FIG. 2 is a graph showing temperature dependency of the amount of corrosion in a corrosion test in an environment including Cl.

As shown in FIG. 1, Al is added in an amount of 1.5% or more for improving corrosion resistance in an environment including Cl. However, when Al is added in an amount of 2.5% or more, fluidity of casting is deteriorated. Therefore, an amount of adding Al is limited to 1.5% to 2.5%. A preferable amount of adding Al is in a range of from 1.8% to 2.2%.

In view of corrosion resistance, it is desirable that C is less added. However, C has effects of improving mechanical strength and fluidity of casting. Therefore, an amount of adding C is limited to 0.1% to 0.5%.

Figure 5:
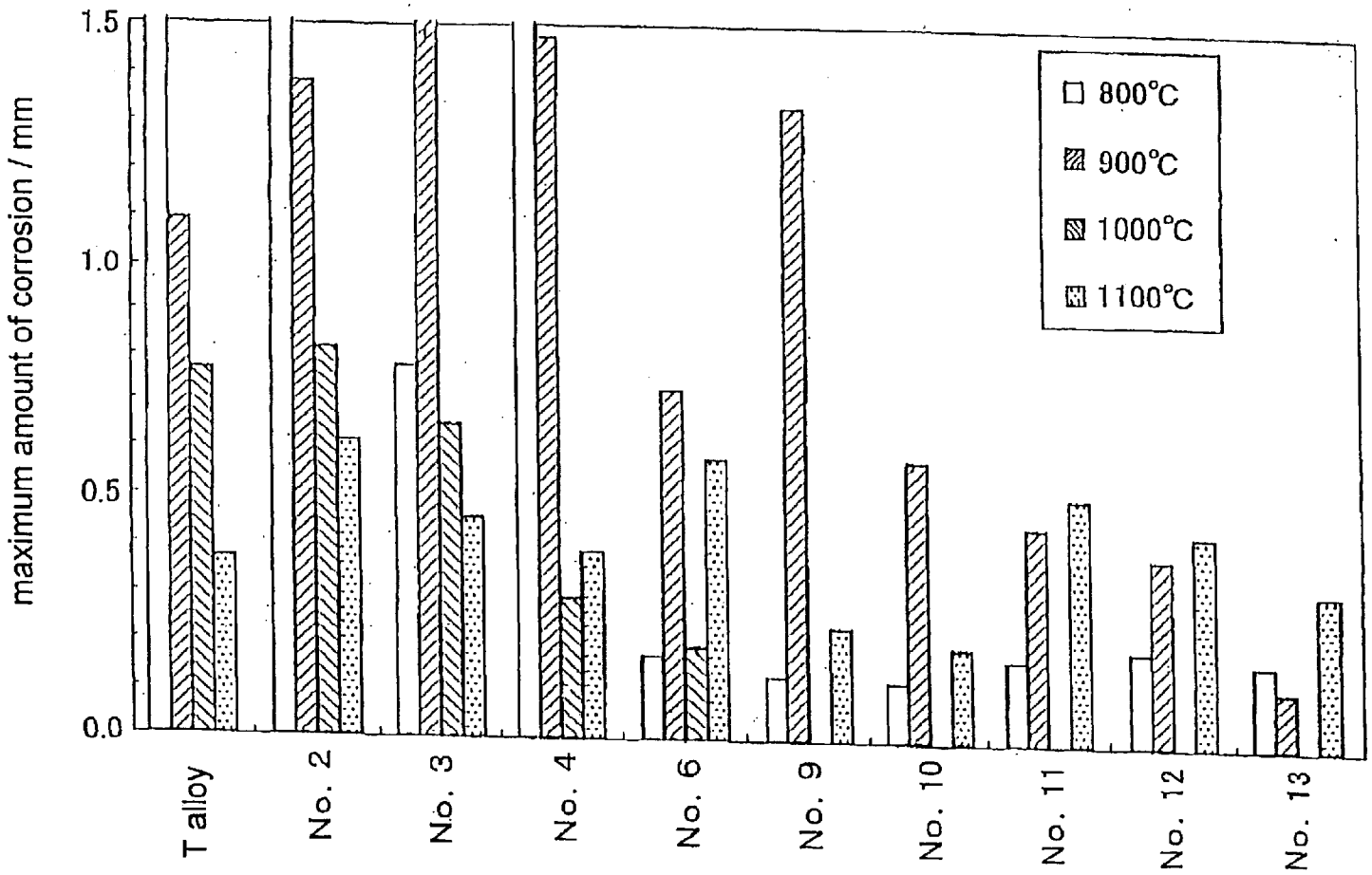
FIG. 5 is a graph showing corrosion resistance at temperatures of 800 to 1100° C. in an environment including Cl with regard to alloys according to the present invention and comparative alloys.
Figure 6:
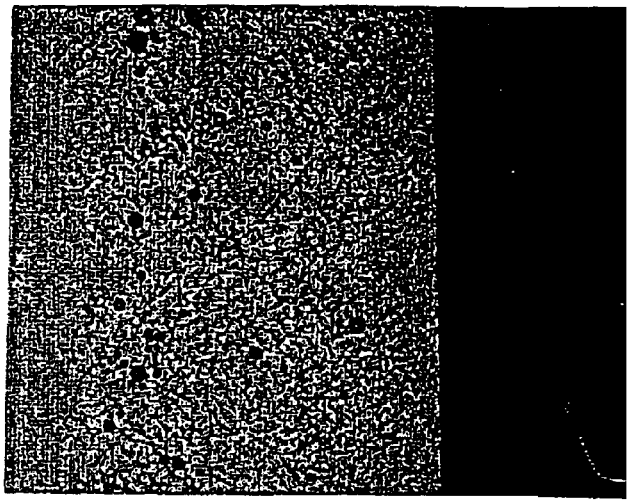
FIG. 6 is microphotographs of cross-sections of a T alloy, which is a conventional alloy having high strength at high temperatures, in a corrosion test at 900° C. in an environment including Cl.
Figure 6:
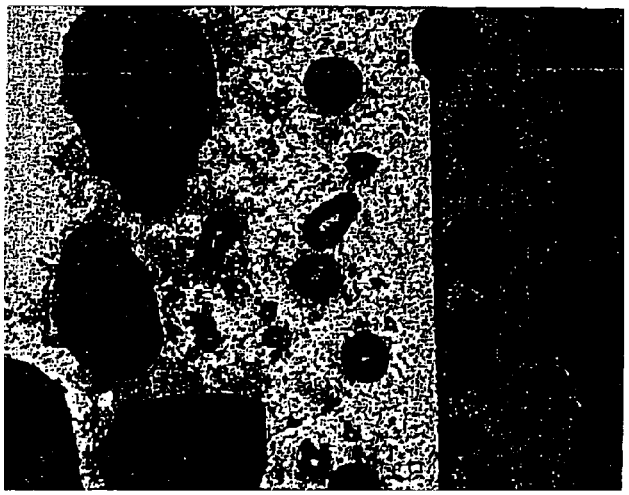
Figure 7:
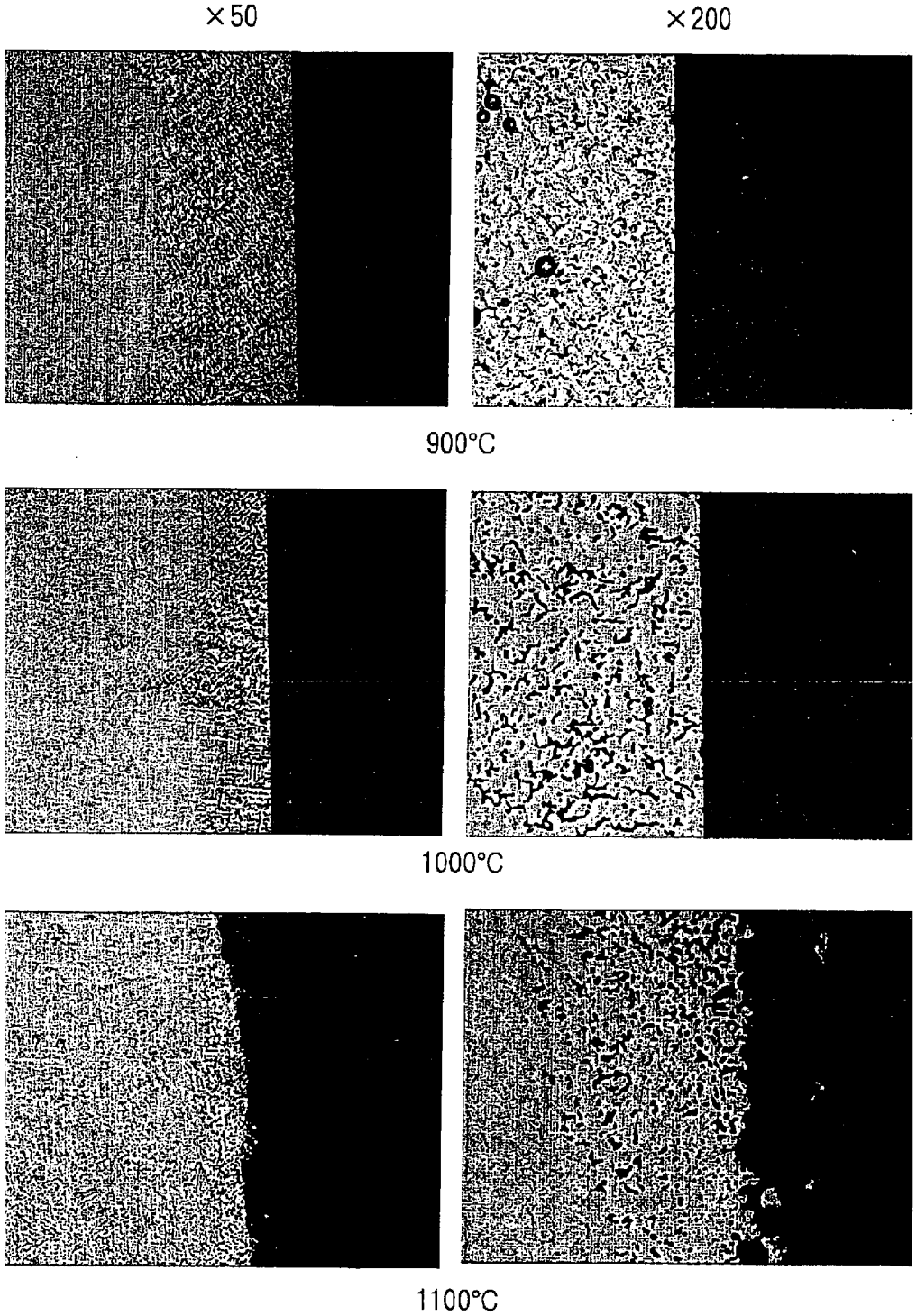
FIG. 7 is microphotographs of cross-sections of a T alloy, which is a conventional alloy having high strength at high temperatures, in corrosion tests at 900° C., 1000° C., and 1100° C. in an environment including Cl.

W is an essential element for enhancing strength at high temperatures. When W is added into a Ni-Cr alloy in an amount of more than 15%, corrosion resistance is deteriorated around 900° C., as shown in the example (FIG. 5). Therefore, an upper limit of the amount of adding W is set to be 15%. On the other hand, in view of using a material at a portion that does not particularly require strength at high temperatures, addition of W increases costs because W is expensive material. Further, as shown in the example, because an alloy including no W may have sufficient corrosion resistance, a lower limit is set to be 0%, which means adding no W.

Because Mn lowers oxidation resistance and strength at high temperatures, it is not desirable to add a large amount of Mn. However, Mn is effective in improving fluidity of casting and serving as a deoxidizing agent and a desulfurizing agent. Therefore, Mn is included in an amount of 2% or less, preferably 1% or less, which does not considerably lower oxidation resistance and strength at high temperatures.

Although Si lowers strength at high temperatures, it is an element effective in improving fluidity of casting and oxidation resistance. A lower limit of the amount of including Si is set to be 0.3%. When a material requires corrosion resistance rather than strength, the amount of Si should be increased so that an upper limit is set to be 6%, which lowered strength but does not become problematic. Although the usual amount of adding Si is in a range of from about 0.3% to about 1.0%, a range preferable for improving corrosion resistance is from 2% to 6%.

In view of corrosion resistance, it is desirable not to include Fe (iron). However, in a case where scrap metal is used as a raw material of the alloy to reduce costs, the alloy may include Fe as impurities. An upper limit of including Fe is set to be 5%, which does not considerably deteriorate performance of an alloy according to the present invention. Practically, the amount of Fe included is preferably 1% or less.

An alloy according to the present invention has mechanical strength so high that it is difficult to process. Therefore, to manufacture mechanical parts using the alloy, casting should be preferable and also can reduce costs.

Further, in a case of manufacturing annular parts using an alloy according to the present invention, it is desirable to manufacture such annular parts by centrifugal casting method. With this method, it is possible to form structures having high corrosion resistance at outer surfaces of the annular parts at low cost.

Furthermore, by varying basic composition in an alloy according to the present invention, it is possible to form an alloy suitable for its purpose.

One of alloys according to the present invention includes Si in a range from 0.3% to 1% and W of 8% or less. Costs can be reduced with reduced amount of W, and the alloy can have strength to some extent and high corrosion resistance with reduced amount of Si.

In a next example, the amount of Si included is set to be 1% to 6%, and the amount of W included is set to be 8% or less in an alloy having the basic composition. Costs can be reduced with reduced amount of W, and the alloy has lowered strength but dramatically improved corrosion resistance with increased amount of Si. Thus, the alloy according to the present invention becomes an excellent corrosion resisting alloy.

Further; the amount of Si included is set to be 0.3% to 1%, and the amount of W included is set to be 8% to 15% in an alloy having the basic composition. Corrosion resistance can be maintained and strength at high temperatures can be maintained to a high level with increased amount of W.

The amount of Si included is set to be 1% to 6%, and the amount of W included is set to be 8% to 15% in an alloy having the basic composition. Strength at high temperatures can be maintained with W, and corrosion resistance can dramatically be improved with increased amount of Si. Thus, strength at high temperatures can be maintained to some extent, and the alloy can have excellent high-temperature corrosion resistance.

Further, the amount of Fe included is set to be 1% or less in an alloy having the basic composition. High-temperature corrosion resistance can be improved with reduced amount of Fe as impurities. Since Fe includes impurities, the amount of the Fe should preferably be as small as possible.

EXAMPLES

Specific examples according to the present invention will be described below. The present invention is not limited to these examples.

Example 1

Testing Alloy

In order to examine characteristics of a Ni base alloy according to the present invention, specimens of alloys, having different compositions, according to the present invention and comparative specimens of various alloys were prepared, and various tests were taken on these specimens. The alloys according to the present invention were manufactured by centrifugal casting method.

Compositions of alloys used in the tests are shown in Table 1.

TABLE 1

Chemical compositions of specimens used in tests

| Number | C | Si | Mn | P | S | Cu | Ni | Cr | Mo | W | Al | Fe | |
|---|---|---|---|---|---|---|---|---|---|---|---|---|---|
| T alloy | 0.28 | 0.68 | 0.69 | 0.002 | 0.002 | 0.03 | 49.9 | 32.3 | 0.02 | 16.82 | <0.1 | 0.01 | Commercial alloy |
| No. 1 | 0.25 | 0.79 | 0.80 | 0.002 | 0.002 | 0.01 | 64.9 | 32.9 | 0.01 | <0.01 | <0.01 | 0.55 | |
| No. 2 | 0.27 | 0.86 | 0.62 | 0.003 | 0.002 | 0.01 | 60.6 | 32.6 | 0.01 | 5.14 | <0.01 | 0.09 | |
| No. 3 | 0.28 | 1.76 | 0.90 | 0.002 | 0.002 | 0.01 | 63.4 | 33.5 | 0.01 | <0.01 | <0.01 | 0.47 | |
| No. 4 | 0.27 | 3.61 | 0.75 | 0.003 | 0.002 | 0.01 | 61.8 | 33.7 | 0.01 | <0.01 | <0.01 | 0.30 | |
| No. 5 | 0.26 | 1.77 | 0.74 | 0.003 | 0.002 | 0.02 | 60.1 | 32.6 | 0.01 | 4.67 | <0.01 | 0.01 | |
| No. 6 | 0.26 | 0.91 | 0.73 | 0.002 | 0.002 | 0.01 | 62.9 | 33.5 | <0.01 | 0.01 | 1.95 | 0.07 | Present invention |
| No. 7 | 0.27 | 0.81 | 0.81 | 0.002 | 0.002 | 0.02 | 58.7 | 32.7 | 0.01 | 4.72 | 2.13 | 0.08 | Present invention |
| No. 8 | 0.27 | 0.79 | 0.66 | 0.003 | 0.002 | 0.02 | 56.4 | 37.2 | 0.01 | 4.99 | <0.01 | 0.09 | |
| No. 9 | 0.28 | 0.79 | 0.59 | 0.002 | 0.003 | 0.05 | 46.6 | 33.2 | 0.03 | 15.61 | 2.06 | 0.30 | |
| No. 10 | 0.27 | 0.80 | 0.57 | 0.002 | 0.002 | 0.04 | 52.6 | 33.0 | 0.02 | 9.84 | 2.05 | 0.26 | Present invention |
| No. 11 | 0.27 | 2.04 | 0.59 | 0.002 | 0.002 | 0.04 | 56.2 | 33.1 | 0.02 | 5.01 | 2.02 | 0.32 | Present invention |
| No. 12 | 0.27 | 2.13 | 0.57 | 0.001 | 0.002 | 0.05 | 51.3 | 33.0 | 0.02 | 10.07 | 2.06 | 0.25 | Present invention |
| No. 13 | 0.27 | 3.84 | 0.57 | 0.002 | 0.003 | 0.04 | 50.5 | 32.5 | 0.03 | 9.58 | 2.03 | 0.37 | Present invention |

Exposure Test

1. Conditions of Exposure

Atmosphere: Atmosphere in which $O_2$ coexists with Cl, S, and the like.

Temperature of atmosphere: 850 to 980° C.

Time of exposure: 554 hours

2. Measuring Method

Changes (unit: mm) of an outside diameter were measured before and after the test, and the amount of reduced thickness due to corrosion was calculated.

3. Measuring Results

Figure 3:
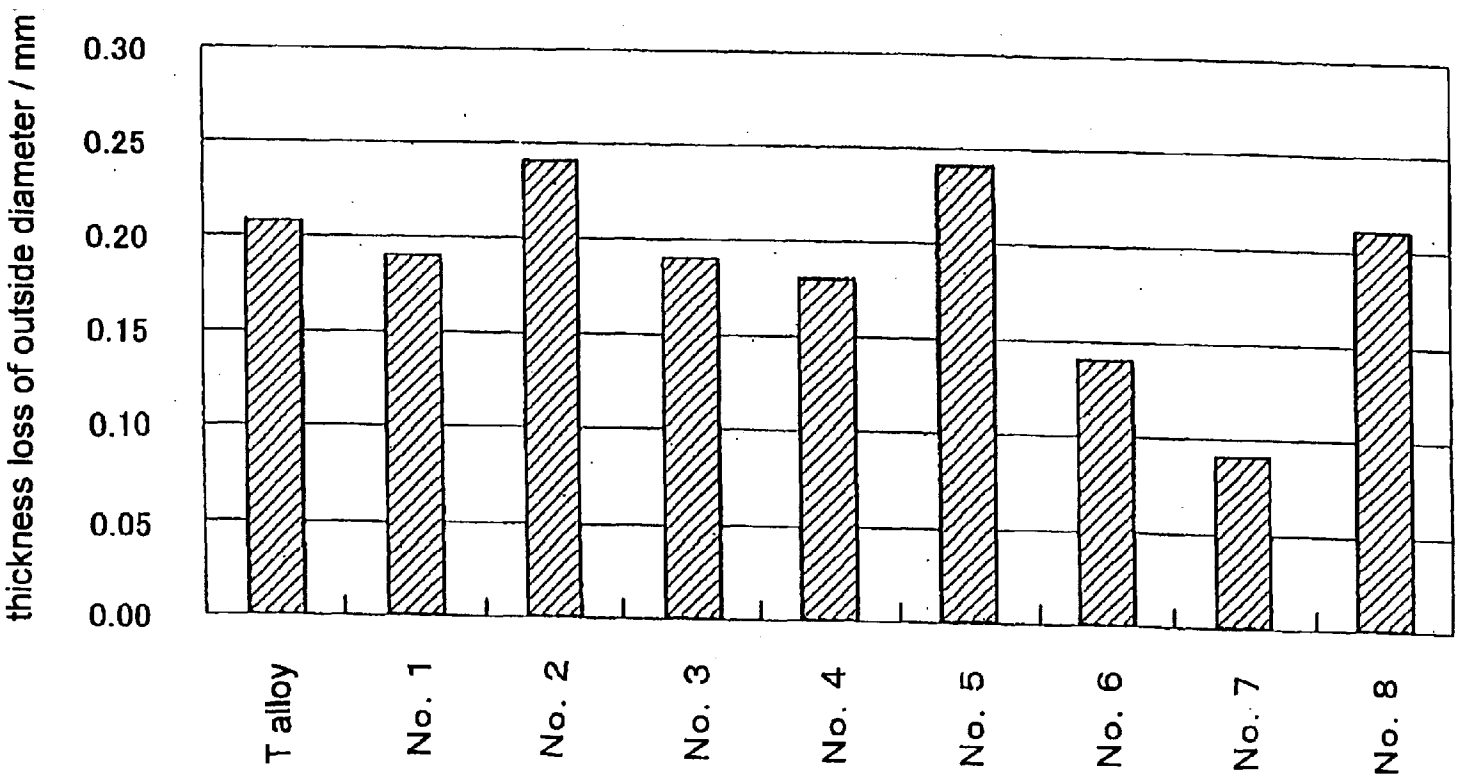
FIG. 3 is a graph showing the amount of corrosion in an exposure test in an environment in which $O_2$, Cl, and S coexist, with regard to alloys according to the present invention and comparative alloys.

The measuring results are shown in FIG. 3.

It can be seen from FIG. 3 that each of alloys according to the present invention into which Al was added had a small amount of reduced thickness and was less likely to be subject to corrosion and was improved in corrosion resistance.

Oxidation test

1. Conditions of Exposure

Atmosphere: Air

Temperature of atmosphere: 1100° C.

Time of exposure: 200 hours

2. Measuring Method

Corrosion loss (unit: $mg/cm^2$) due to oxidation was measured after descaling.

3. Measuring Results

Figure 4:
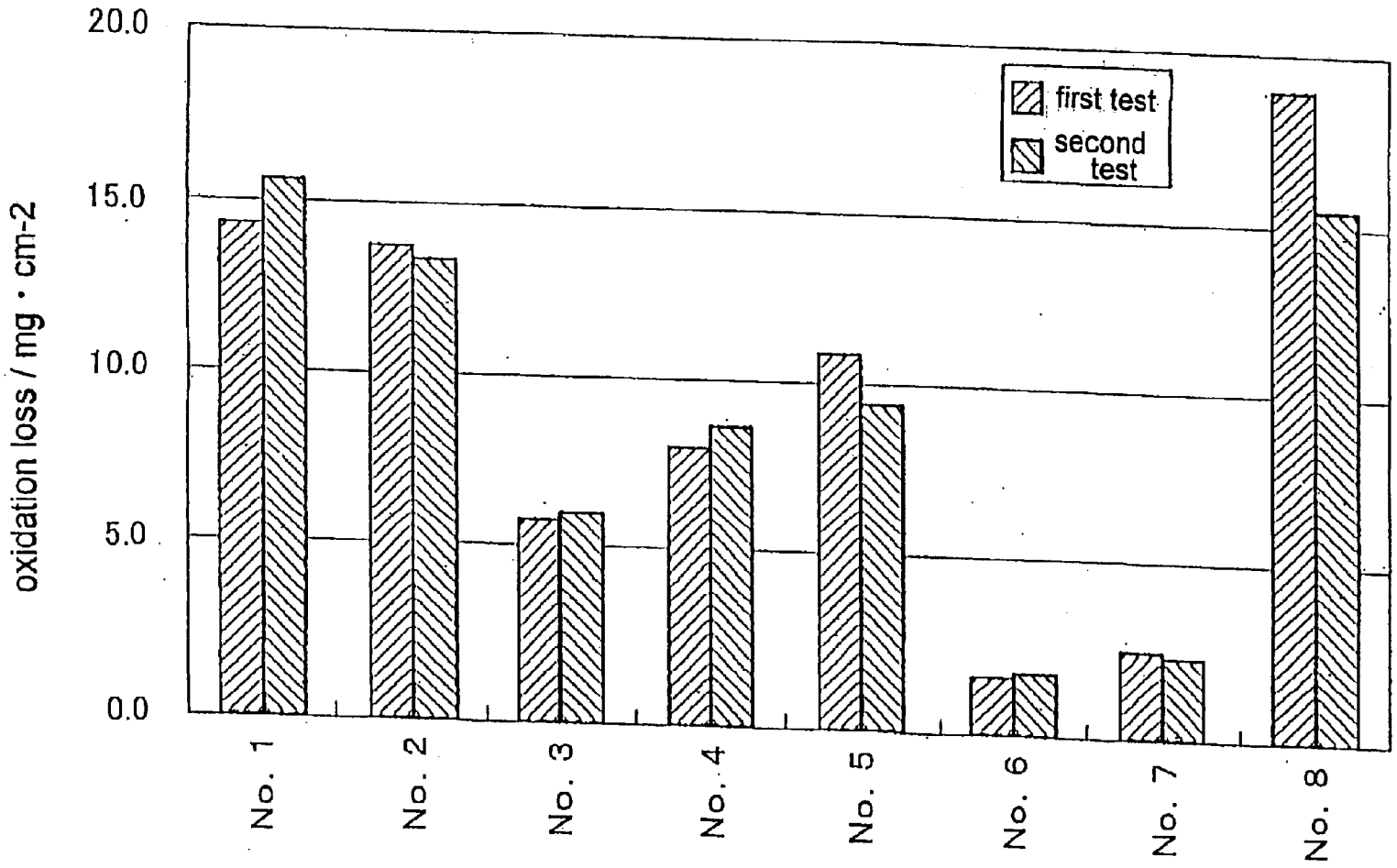
FIG. 4 is a graph showing resistance to high-temperature oxidation at 1100° C. in atmospheric air with regard to alloys according to the present invention and comparative alloys.

The measuring results are shown in FIG. 4. FIG. 4 is a graph showing resistance to high-temperature oxidation in atmospheric air with regard to alloys according to the present invention and the comparative alloys.

It can be seen from FIG. 4 that each of alloys of the specimens Nos. 6 and 7 according to the present invention into which Al is added was remarkably improved in oxidation resistance.

Corrosion Test

1. Conditions of Exposure

Atmosphere: $N_2$ gas including $O_2$ of 10% and Cl of 1000 ppm

Temperature of atmosphere: 800 to 1100° C.

Time of exposure: 200 hours

2. Measuring Method

The specimens were cut, and the maximum corrosion depth (unit: mm) of corrosion portions in the cross-section was measured to calculate the amount of corrosion.

3. Measuring Results

The measuring results are shown in FIG. 5. FIG. 5 is a graph showing corrosion resistance in an environment including Cl with regard to alloys according to the present invention and the comparative alloys.

An alloy according to the present invention has high resistance to high temperatures and high corrosion resistance, and since it is effective in a strongly corrosive environment including Cl in particular, it is possible to provide a metallic material having long lifetime and high reliability which can be used in an environment where it is difficult to use a conventional alloy.

Further, in a strongly corrosive environment in which chlorination, sulfidation, or the like occurs simultaneously with high-temperature oxidation, an alloy according to the present invention is less likely to be subject to corrosion even if it is used at a high temperature. When the alloy is used at a high temperature of 1000° C. or higher, it is less likely to be subject to corrosion. Accordingly, the alloy can be used in a high-temperature corrosive atmosphere.

Further, it is possible to provide an alloy composition suitable for its use. For example, when strength to some extent is merely required, it is possible to provide an alloy having sufficient corrosion resistance with reduced cost. Furthermore, when large strength is not required but sufficiently high corrosion resistance is required, it is possible to provide an alloy to meet such demands with reduced cost.

INDUSTRIAL APPLICABILITY

The present invention can be utilized for materials used in a strongly corrosive environment in which chlorination, sulfidation, or the like occurs simultaneously with high-temperature oxidation.

What is claimed is:

1. An Ni base alloy having high-temperature strength and corrosion resistance, said Ni base alloy including Cr in a range of from 25 to 40 weight %, Al in a range of from 1.5 to 2.5 weight %, C in a range of from 0.1 to 0.5 weight %, W of 15 weight % or less, Mn of 2.0 weight % or less, Si in a range of from 0.3 to 6 weight %, Fe of 5% or less, and Ni of rest except inevitable impurities.

2. An Ni base alloy having high-temperature strength and corrosion resistance according to claim 1, said Ni base alloy characterized by including W of 8 weight % or less, and Si in a range of from 0.3 to 1 weight %.

3. An Ni base alloy having high-temperature strength and corrosion resistance according to claim 1, said Ni base alloy characterized by including W of 8 weight % or less, and Si in a range of from 1 to 6 weight %.

4. An Ni base alloy having high-temperature strength and corrosion resistance according to claim 1, said Ni base alloy characterized by including W in a range of from 8 to 15 weight %, and Si in a range of from 0.3 to 1 weight %.

5. An Ni base alloy having high-temperature strength and corrosion resistance according to claim 1, said Ni base alloy characterized by including W in a range of from 8 to 15 weight %, and Si in a range of from 1 to 6 weight %.

6. An Ni base alloy having high-temperature strength and corrosion resistance, said Ni base alloy including Cr in a range of from 25 to 40 weight %, Al in a range of from 1.5 to 2.5 weight %, C in a range of from 0.1 to 0.5 weight %, W of 15 weight % or less, Mn of 2.0 weight % or less, and Si in a range of from 2 to 6 weight %.

* * * * *